US011009213B2

(12) United States Patent
Qin

(10) Patent No.: US 11,009,213 B2
(45) Date of Patent: May 18, 2021

(54) PNEUMATICALLY SWITCHED BALLOON LIGHT

(71) Applicant: ACE LIGHT & ELECTRONIC TECH (NINGBO) CO., LTD., Ningbo (CN)

(72) Inventor: Yanbei Qin, Ningbo (CN)

(73) Assignee: ACE LIGHT & ELECTRONIC TECH (NINGBO) CO., LTD., Ningbo (CN)

( * ) Notice: Subject to any disclaimer, the term of this patent is extended or adjusted under 35 U.S.C. 154(b) by 42 days.

(21) Appl. No.: 16/344,770

(22) PCT Filed: Jun. 12, 2018

(86) PCT No.: PCT/CN2018/090844
§ 371 (c)(1),
(2) Date: Apr. 24, 2019

(87) PCT Pub. No.: WO2019/223035
PCT Pub. Date: Nov. 28, 2019

(65) Prior Publication Data

US 2020/0263853 A1 Aug. 20, 2020

(30) Foreign Application Priority Data

May 23, 2018 (CN) ..... 201810498375.3

(51) Int. Cl.
*F21V 3/02* (2006.01)
*A63H 27/10* (2006.01)
(Continued)

(52) U.S. Cl.
CPC ..... *F21V 3/023* (2013.01); *A63H 27/10* (2013.01); *F21V 23/04* (2013.01); *F21V 23/06* (2013.01);
(Continued)

(58) Field of Classification Search
None
See application file for complete search history.

(56) References Cited

U.S. PATENT DOCUMENTS 7,147,536 B1 * 12/2006 Hartelius ..... A63H 27/10 446/220
7,318,765 B1 1/2008 Hartelius
(Continued)

FOREIGN PATENT DOCUMENTS

CN 201599718 U 10/2010
CN 201684419 U 12/2010
(Continued)

OTHER PUBLICATIONS

International Search Report dated Dec. 12, 2018 from related PCT Application No. PCT/CN2018/090843.
(Continued)

*Primary Examiner* — Elmito Breval
(74) *Attorney, Agent, or Firm* — Innovation Capital Law Group, LLP; Vic Lin

(57) ABSTRACT

A pneumatically switched balloon light comprises a balloon body which has an air inlet; a battery case located in the balloon body, wherein the battery case is provided with two adjacent batteries and an LED light connected with the batteries; a shield body located in the air inlet, wherein one end of the shield body is removably connected with the battery case, and the other end is made with a breather hole; a valve cover arranged in the shield body and separated from the breather hole; and an insulating piece, one end of which is fixedly connected with the valve cover, and the other end is inserted between the batteries; and the shield body is made with the breather hole for the air intake and discharge, and the shield body and the battery case can be directly fixed in the balloon body.

9 Claims, 4 Drawing Sheets

(51) Int. Cl.
*F21V 23/04* (2006.01)
*F21V 23/06* (2006.01)
*F21Y 115/10* (2016.01)

(52) U.S. Cl.
CPC ..... *A63H 2027/1041* (2013.01); *A63H 2027/1058* (2013.01); *A63H 2027/1083* (2013.01); *F21Y 2115/10* (2016.08)

(56) References Cited

U.S. PATENT DOCUMENTS

| | | | | |
|---|---|---|---|---|
| 2005/0269442 | A1* | 12/2005 | Nguyen | G09F 21/10 244/31 |
| 2009/0067154 | A1 | 3/2009 | Carito | |

FOREIGN PATENT DOCUMENTS

| | | | |
|---|---|---|---|
| CN | 102500114 | A | 6/2012 |
| CN | 202501358 | U | 10/2012 |
| CN | 202607607 | U | 12/2012 |
| CN | 205690153 | U | 11/2016 |

OTHER PUBLICATIONS

International Search Report dated Dec. 12, 2018 from corresponding PCT Application No. PCT/CN2018/090844.

* cited by examiner

PNEUMATICALLY SWITCHED BALLOON LIGHT

BACKGROUND OF THE INVENTION

1. Technical Field

The present invention belongs to the field of photoelectric technology, and relates to a balloon light, and more especially, to a pneumatically switched balloon light.

2. Description of Related Art

As an innovative material used in activity arrangements, the LED balloon light provides a new creative idea for arranging various Avenue of Stars, outdoor lawns, open squares, and emptying stages in activities. It combines activity lighting, activity slogans, activity spaces, and activity decoration, adding a lot of highlights to the activities and showing the activity's taste. The light is especially suitable for creating a site atmosphere for high-end activities, and has a wide range of applications.

For example, the invention patent with the Authorized Publication No. of 201684419U discloses a colorful balloon with LED lights which comprises a balloon body, wherein the balloon body has an air inlet in the middle of its bottom, the upper end of the air inlet is fixed with an LED light power supply and circuit case with a battery, an LED light fixing plate is provided on the upper end of the case, an LED light group is fixed on the fixing plate and a plug is inserted in the end opening of the air inlet. This balloon can emit light, but it has the following technical problems: 1. the LED light group is fixedly connected with the plug, and the plug is inserted into the air inlet of the balloon body, so the LED light group has to be removed together with the plug to let the air in or out of the balloon body, which is quite inconvenient for use; 2. In this structure, a switch is provided to control the on and off of the LED lights, which is not convenient for control, and the plug is repeatedly removed and replaced for a long time, which will greatly affect the stability of the switch and shorten the service life.

To sum up, in order to solve the technical problems of the above-mentioned balloon with lights, there is a need to design a pneumatically switched balloon light that does not need to be disassembled, is convenient to use, and has a long service life.

BRIEF SUMMARY OF THE INVENTION

The present invention aims to provide a pneumatically switched balloon light that does not need to be disassembled, is convenient to use, and has a long service life, to solve the foregoing problems in the prior art.

The objective of the present invention can be achieved by the following technical solution: a pneumatically switched balloon light, comprising

- a balloon body which has an air inlet;
- a battery case located in the balloon body, wherein the battery case is provided with two adjacent batteries and an LED light connected with the two batteries;
- a shield body located in the air inlet, wherein one end of the shield body is removably connected with the battery case, and the other end is provided with a breather hole;
- a valve cover arranged in the shield body and separated from the breather hole;

- an insulating piece, one end of which is fixedly connected with the valve cover, and the other end is inserted between the two batteries; and
- when the air pressure in the balloon body is greater than the atmospheric pressure outside, the valve cover and the insulating piece move synchronously within the shield body, until the valve cover blocks up the breather hole, the insulating piece disengages itself from the batteries, and the batteries are electrically connected with the LED light.

In the foregoing pneumatically switched balloon light, an insertion-connection block is convexly provided inside the valve cover, and the insertion-connection block is provided with a slot for inserting and fixing the insulating piece.

In the foregoing pneumatically switched balloon light, the valve cover has a tapered portion at one end, a tapered socket is correspondingly provided in the shield body, the breather hole is co-axial and communicates with the tapered socket, and the tapered portion is pressed against the surface of the tapered socket.

In the foregoing pneumatically switched balloon light, the outer surface of the battery case is laterally provided with a retaining block, and the inner surface of the shield body is correspondingly made with a retaining groove, such that the retaining block is embedded in the retaining groove.

In the foregoing pneumatically switched balloon light, the outer surface of the battery case is laterally provided with a stop block such that when the retaining block is in the retaining groove, one end of the shield body rests against the stop block.

In the foregoing pneumatically switched balloon light, the outer surface of the battery case is provided with an axially extending breather groove, and the breather groove communicates with the balloon body and the shield body respectively.

In the foregoing pneumatically switched balloon light, a mounting shield is fixedly provided in the battery case, the batteries are located in the mounting shield, a receiving opening is provided in one side of the mounting shield, and an insertion hole corresponding to the receiving opening is made in one end of the battery case, such that the insulating piece is located in the insertion hole and the receiving opening and moves in the insertion hole and the receiving opening.

In the foregoing pneumatically switched balloon light, one end of the battery case is provided with a mounting holder, the inside of which is made with a mounting groove, the LED light is disposed on a light base, the light base is locked in the mounting groove and the LED light passes through the mounting holder.

In the foregoing pneumatically switched balloon light, a sealing sleeve is provided outside the balloon body, the balloon body is located between the shield body and the sealing sleeve, the sealing sleeve is removably connected with the shield body, and the balloon body is pressed against the sealing sleeve and the shield body respectively.

In the foregoing pneumatically switched balloon light, the outer surface of the shield body is provided with a locking block around the outer surface thereof, and the sealing sleeve is provided with a locking groove around the inner surface thereof, such that the locking block is in the locking groove and the balloon body is pressed against the locking block and the locking groove respectively.

Compared with the prior art, the present invention has the following beneficial effects:

1. In the invention, the shield body is made with a breather hole for the air intake and discharge, so that the battery case and the shield body need not to be removed, and the shield body and the battery case can be directly fixed in the balloon body, so the balloon light is convenient to use and has better structural stability.

2. When the air comes into the balloon body and the air pressure in the balloon body is greater than the atmospheric pressure outside, under the action of the internal air pressure, the valve cover will drive the insulating piece to move inside the shield body, so that the insulating piece is separated from the batteries, and the batteries supply power to the LED light, thereby achieving control of the on and off of the LED light. The control structure is simple and convenient, and has a longer service life.

Figure 1:
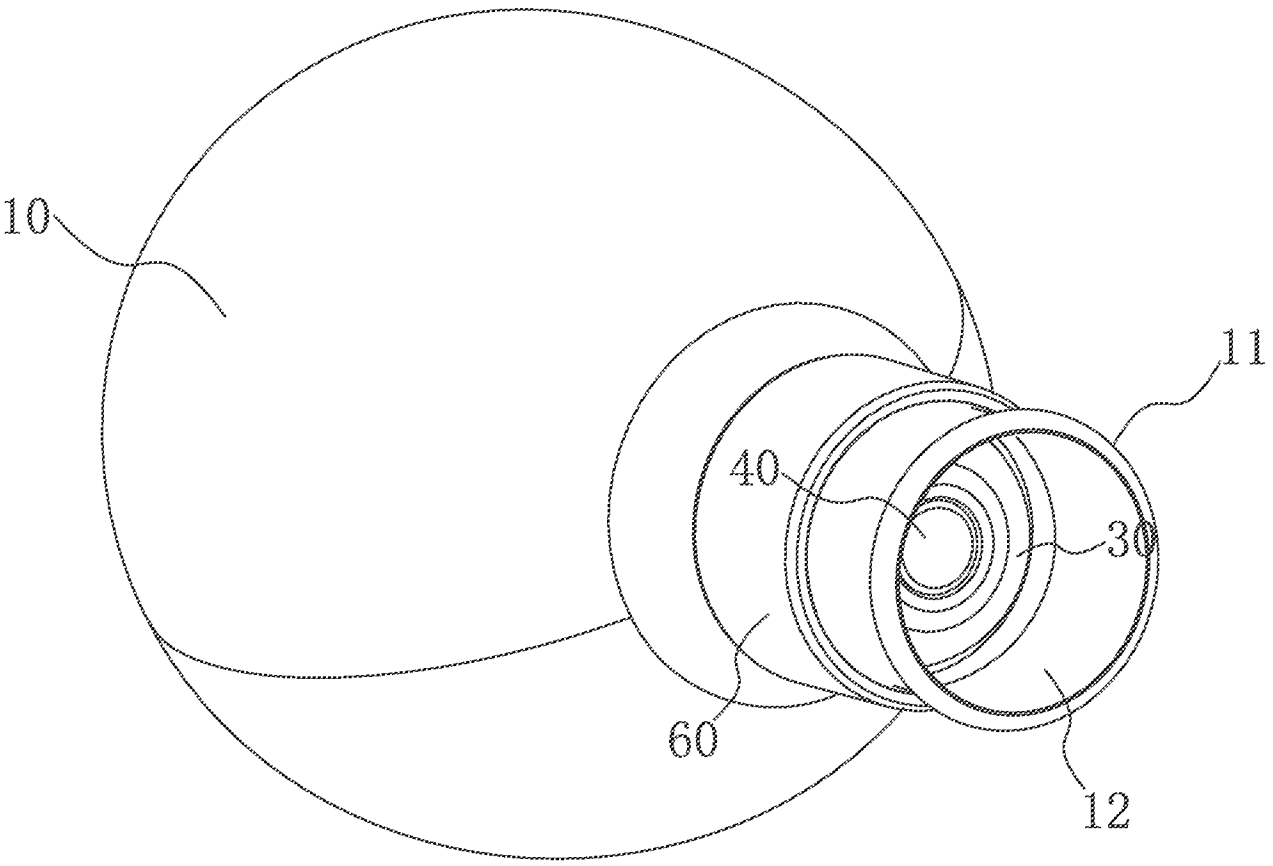
FIG. 1 is a perspective structural diagram of the present invention.

In the drawings: 10. balloon body; 11. air guide portion; 12. air inlet; 20. battery case; 21. batteries; 22. LED light; 23. retaining block; 24. stop block; 25. breather groove; 26. upper case body; 27. lower case body; 27*a*. mounting shield; 27*b*. receiving opening; 28. insertion hole; 29. mounting holder; 29*a*. mounting groove; 30. shield body; 31. breather hole; 32. tapered socket; 33. retaining groove; 34. locking block; 40. valve cover; 41. insertion-connection block; 42. slot; 43. tapered portion; 50. insulating piece; 60. sealing sleeve; 61. locking groove.

DETAILED DESCRIPTION OF THE INVENTION

The detailed implementation of the present invention will be given below, and the technical solution of the present invention will be further described in combination with the drawings, but the present invention is not limited to these embodiments.

The present invention aims to improve the existing balloon with lights and solve the technical problems of inconvenient use and a short service life, so as to improve the manipulation performance of the balloon with lights and prolong its service life.

As shown in FIGS. 1-4, a pneumatically switched balloon light of the present invention comprises a balloon body 10, a battery case 20, a shield body 30, a valve cover 40 and an insulating piece 50.

The balloon body 10 is a spherical structure made of a latex material. The balloon body 10 has an air guide portion 11 in which an air inlet 12 is made. The battery case 20 is located in the balloon body 10, two adjacent batteries 21 are provided in the battery case 20, and one end of the battery case 20 towards the inside of the balloon body 20 is mounted with an LED light 22 which is electrically connected with the batteries 21. The shield body 30 is located in the air guide portion 11, the shield body 30 and the air guide portion 11 are relatively fixed and sealed there between, and one end of the shield body 30 is removably connected with the battery case 20 while the other end has a breather hole 31 which communicates with the interior of the balloon body 10. The valve cover 40 is arranged in the shield body 30 and separated from the breather hole 31. One end of the insulting piece 50 is fixedly connected with the valve cover 40, and the other end is inserted between the batteries 21.

In operation, the balloon body 10 is filled with air through the air inlet 12. When the balloon body 10 inflates and the air pressure in the balloon body 10 is greater than the atmospheric pressure outside, since the valve cover 40 is separated from the shield body 30, under the action of the air pressure in the balloon body 10, the valve cover 40 and the insulating piece 50 move synchronously within the shield body 30, until the valve cover 40 blocks up the breather hole 31, the insulating piece 50 disengages itself from the batteries 21, and the batteries 21 are electrically connected with the LED light 22, thereby enabling the LED light 22 to emit light inside the balloon body 10.

Of course, the balloon body 10 can also emit light without sufficient gas. When a small amount of gas is filled into the balloon body 10, the air pressure inside the balloon body 10 can be instantaneously increased by tapping the balloon body 10, so that the gas inside the balloon body 10 flows towards the air inlet 12, and during the flow, it will drive the valve cover 14 to move and block up the breather hole 31, which can also enable the LED light 22 to emit light.

To discharge the air out of the balloon body 10, press the valve cover 40 until it is away from the shield body 30. While air discharge of the balloon body 10 is achieved, the insulating piece 50 is inserted between the batteries 21 to turn off the LED light 22.

In the present invention, the valve cover 40 and the insulating piece 50 move in the shield body 30, which not only can achieve the air intake and discharge of the balloon body 10, but also control the on and off of the LED light 22. The balloon light is convenient to use without removing the battery case 20, and has a more stable structure and a longer service life.

It should be noted that in this structure, the breather hole 31 is blocked up by the valve cover 40, so the air guide portion 11 does not have to be knotted when the inflation of the balloon body 10 is done, which makes inflation and deflation convenient and efficient.

According to the present invention, the foregoing structure is further improved and refined.

Figure 2:
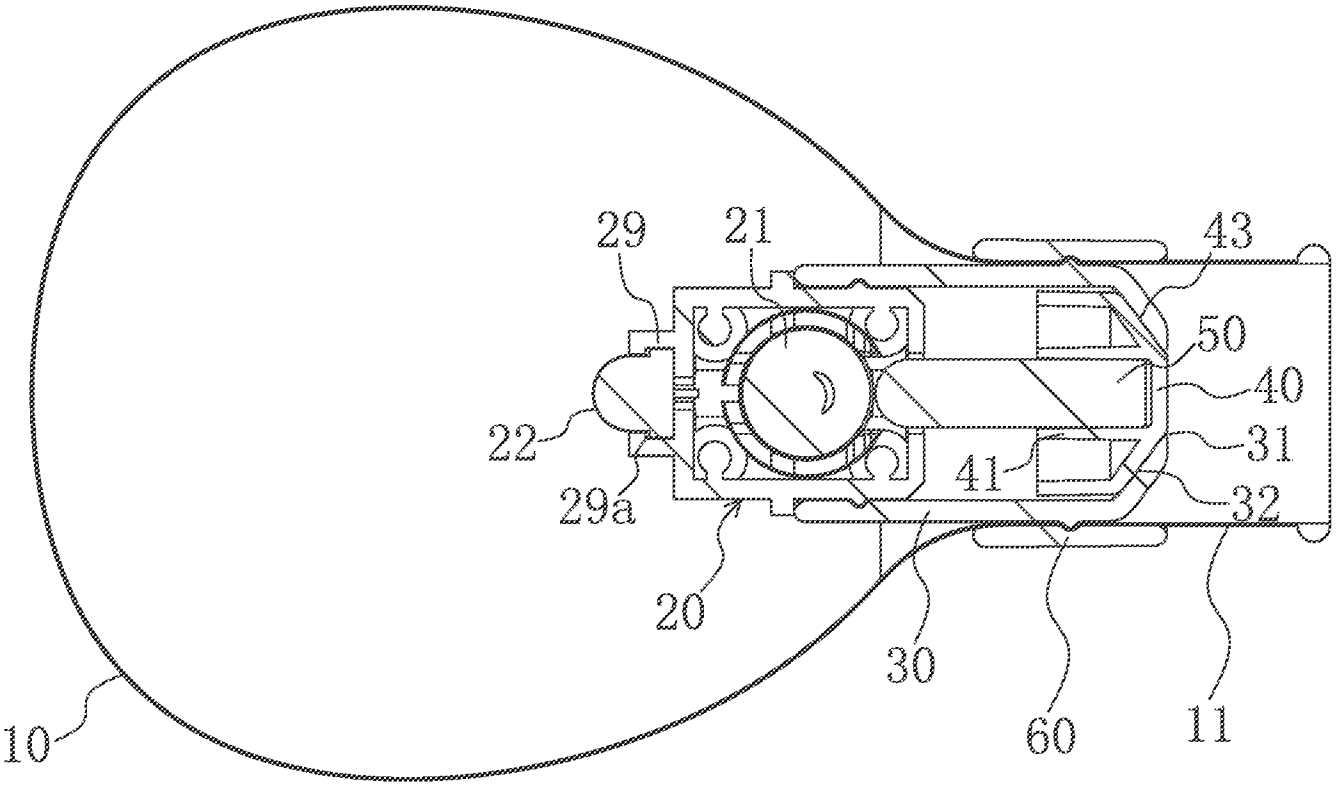
FIG. 2 is an axial section view of the present invention.
Figure 3:
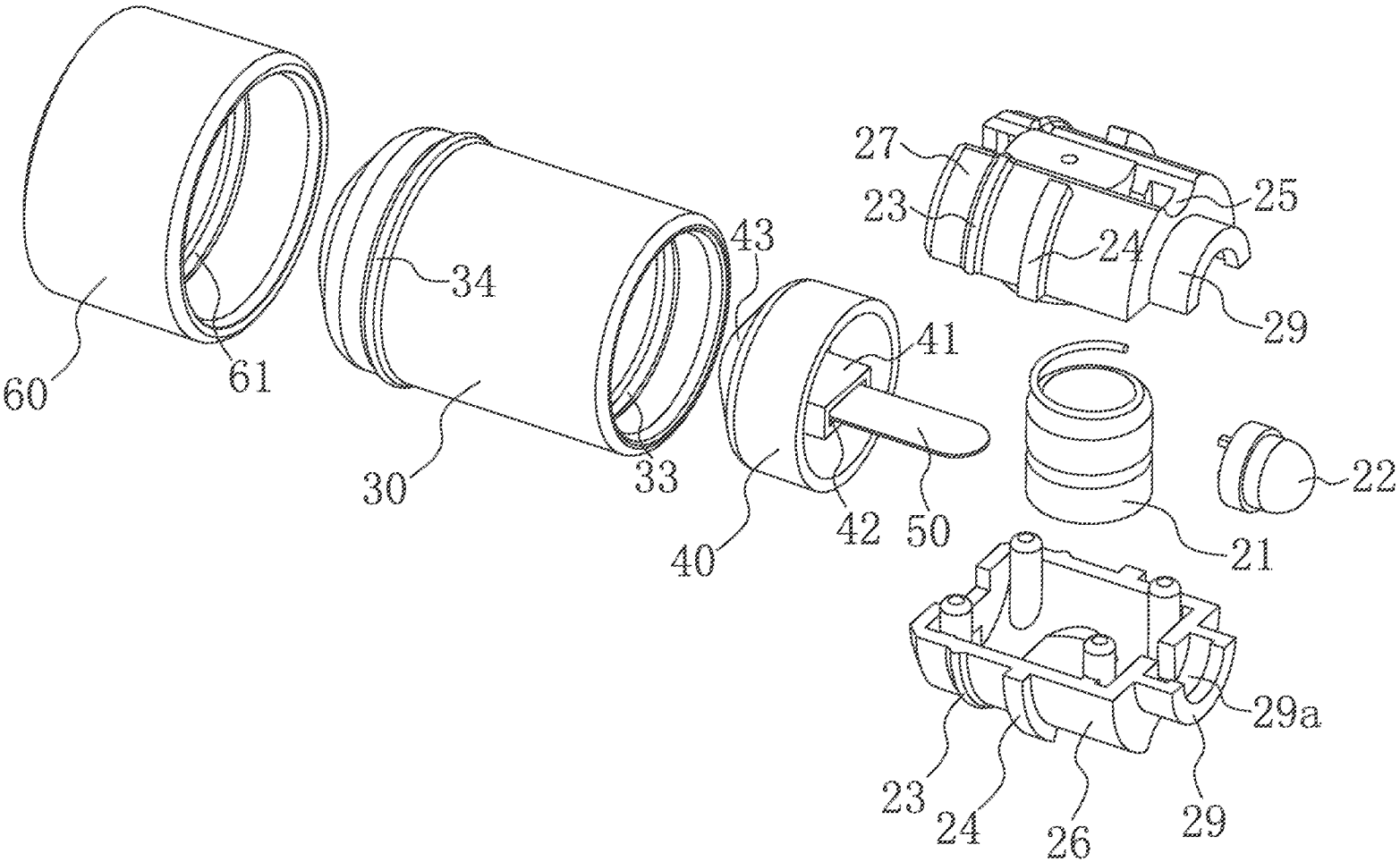
FIG. 3 is a schematic exploded view of the present invention.
Figure 4:
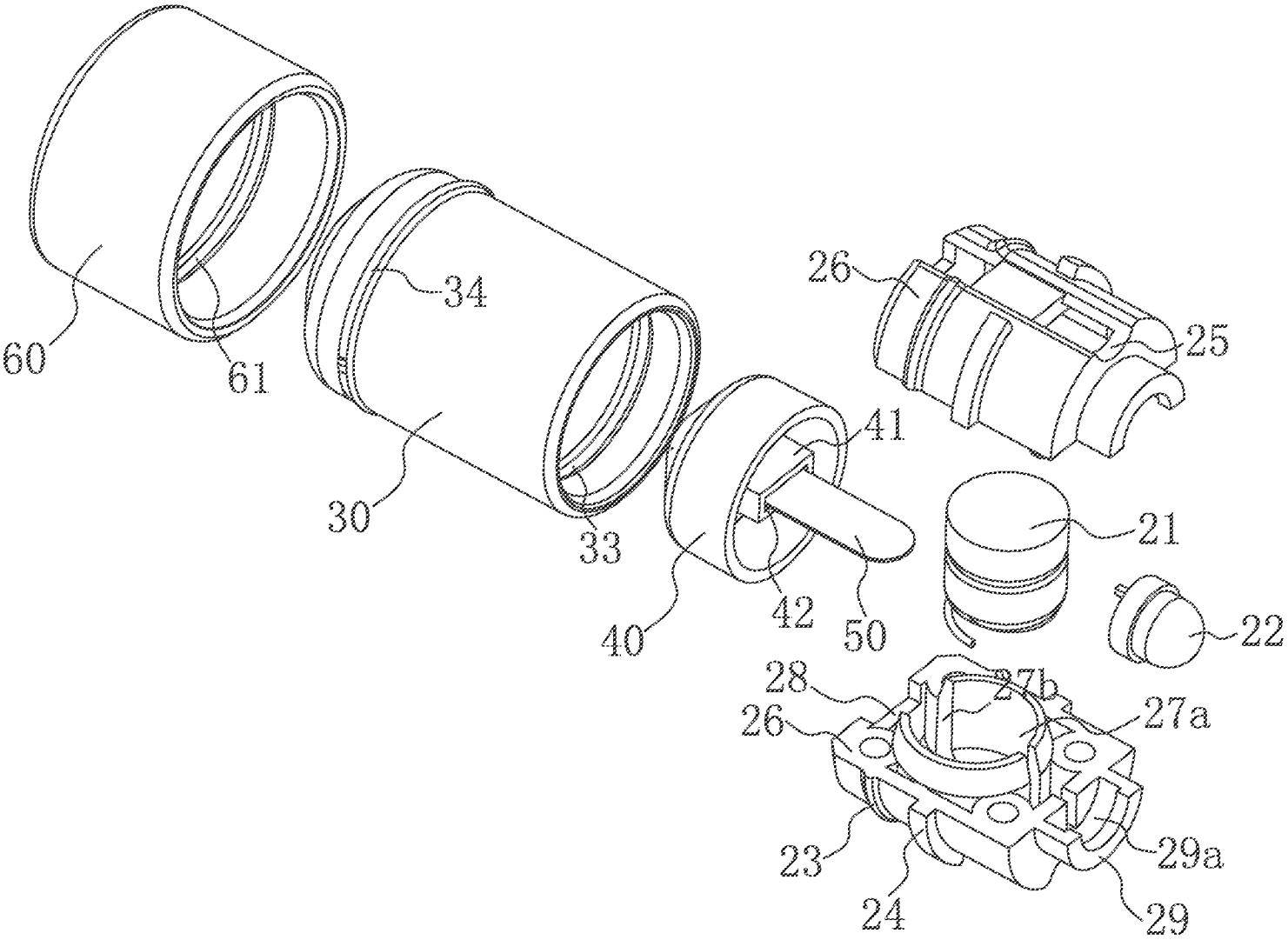
FIG. 4 is a schematic exploded view of the present invention from another perspective.

As shown in FIGS. 2-4, an insertion-connection block 41 is provided inside the valve cover 40, and the insertion-connection block 41 is made with a slot 42 for inserting and fixing the insulating piece 50.

The insulating piece 50 is inserted and connected with the insertion-connection block 41 to fix the insulating piece 50 and the valve cover 40 together, which makes it easy to assemble and disassemble the insulating piece 50 and the valve cover 40, and convenient to replace the insulating piece 50.

As shown in FIGS. 2-4, the valve cover 40 has a tapered portion 43 at one end close to the air inlet 31, a tapered socket 32 is correspondingly provided in the shield body 30, the breather hole 31 is co-axial and communicates with the tapered socket 32, and the tapered portion 43 is pressed against the surface of the tapered socket 32.

The contact portion of the valve cover 40 and the shield body 30 is configured into a tapered structure, so that the valve cover 40 is in closer contact with the shield body 30, thereby improving the stability of the valve cover 40 when it comes into contact with the shield body 30, and also improving the seal between the valve cover 40 and the shield body 30 which prevents the balloon body 10 from leaking.

As shown in FIGS. 2-4, the outer surface of the battery case 20 is laterally provided with a retaining block 23, and the inner surface of the shield body 30 is correspondingly made with a retaining groove 33, such that the retaining block 32 is embedded in the retaining groove 33.

The fit of the retaining block 23 and the retaining groove 33 allows the battery case 20 and the shield body 30 to be connected and fixed together, so that the battery case 20 and the shield body 30 are stable and therefore do not easily move relative to each other.

Of course, when a relatively large force is applied to the battery case 20 and the shield body 30 respectively in an opposite direction, the battery case 20 and the shield body 30 can also be separated, which makes it is quite convenient to assemble and easy to disassemble the battery case 20 and the shield body 30.

As shown in FIGS. 2-4, the outer surface of the battery case 20 is laterally provided with a stop block 24 such that when the retaining block 23 is in the retaining groove 33, one end of the shield body 30 rests against the stop block 24.

In this embodiment, to assemble the battery case 20 and the shield body 30, it is necessary to push the battery case 20 and the shield body 30 with a large force so as to push the battery case 20 into the shield body 30 and the retaining block 23 into the retaining groove 33. However, if the force is too large, the retaining block 23, which has already been pushed into the retaining groove 33, will leave the retaining groove 33 under the action of inertia. By providing the stop block 24, the shield body 30 rests against the stop block 24 when the retaining block 23 enters the retaining groove 33, so that the retaining block 23 always stays in the retaining groove 33, which improves the assembly efficiency.

In addition, the fit of the retaining block 23 and the retaining groove 33 fixedly connects the battery case 20 and the shield body 30 together which do not easily move relative to each other. However, when the air has to be discharged out of the balloon body 10, if the valve cover 40 is pressed by hand, said hand will also touch the shield body 30. When the force is too large, it will also cause the retaining block 23 to leave the retaining groove 33, resulting in the shield body 30 and the battery case 20 moving relative to each other.

As shown in FIG. 3 and FIG. 4, the outer surface of the battery case 20 is made with an axially extending breather groove 25, the breather groove 25 communicates with the balloon body 10 and the shield body 30 respectively, and the breather groove 25 extends through the retaining block 23 and the stop block 24.

By making the breather groove 25, the communication among the breather hole 31, the breather groove 25, and the inside of the balloon body 10 is achieved, and the normal air intake and discharge of the balloon body 10 are ensured.

As shown in FIG. 3 and FIG. 4, the entire battery case 20 is assembled by inserting and connecting the upper case body 26 and the lower case body 27 together, which is convenient to assemble. A mounting shield 27*a* is permanently provided on the inner surface of the lower case body 27, and the batteries 21 are located in the mounting shield 27*a*. A receiving opening 27*b* is made in one side of the mounting shield 27*a*, and an insertion hole 28 corresponding to the receiving opening 27*b* is made in one end of the battery case 20, and the insertion hole 28 is enclosed by gaps in the upper case body 26 and the lower case body 27. The insulating piece 50 is located in the insertion hole 28 and the receiving opening 27*b* and moves in the insertion hole 28 and the receiving opening 27*b*.

The mounting shield 27*a* provides a mounting area for the batteries 21, while avoiding the shaking of the batteries 21, improving the stability of the batteries 21. The insulating piece 50 is located in the insertion hole 28 and the receiving opening 27*b*, so that the insulating piece 50 will not deviate from its normal movement path, and the movement accuracy is higher, which ensures that the insulating piece 50 can be correctly inserted between the batteries 21.

As shown in FIG. 3 and FIG. 4, one end of the battery case 20 is provided with a mounting holder 29, the inside of which is made with a mounting groove 29*a*, the mounting holder 29 is formed by the semi-cylindrical structures fixedly connected with the ends of the upper case body 26 and the lower case body 27, the LED light 22 is disposed on a light base, the light base is locked in the mounting groove 29*a* and the LED light 22 passes through the mounting holder 29.

The LED light 22 is locked in the mounting groove 29*a*, which provides good stability. During assembly of the battery case 20, the LED light 22 is placed in one half of the mounting groove 29*a* first, and then the upper case body 26 and the lower case body 27 are put together to fix the LED light 22, which makes the assembly of the LED light 22 and the battery case 22 very simple and convenient.

As shown in FIG. 1 and FIG. 2, a sealing sleeve 60 is provided outside the air guide portion 11, the air guide portion 11 is located between the shield body 30 and the sealing sleeve 60, the sealing sleeve 60 is removably connected with the shield body 30, and the air guide portion 11 is pressed against the sealing sleeve and the shield body 30 respectively. Preferably, the outer surface of the shield body 30 is circumferentially provided with a locking block 34, and the inner surface of the sealing sleeve 60 is circumferentially made with a locking groove 61, such that the locking block 34 is in the locking groove 61 and the balloon body 10 is pressed against the locking block 34 and the locking groove 61 respectively.

The air guide portion 11 of the balloon body 10 is located between the sealing sleeve 60 and the shield body 30 and clamped by the two to provide a good sealing between the shield body 30 and the balloon body 10 so that the balloon body 10 will not leak. The sealing sleeve 60 and the shield body 30 are engaged with each other by means of the locking block 34 and the locking groove 61, so that the sealing sleeve 60 is easily disassembled from the balloon body 10 and the shield body 30.

The operating principle of the present invention is as follows:

In the initial state, the valve cover 40 is away from the air inlet 31. The balloon body 10 is filled with air by blowing or with an inflating tool. When the balloon body 10 is inflated to a predetermined size and the air pressure in the balloon body 10 is greater than the atmospheric pressure outside, under the action of the air pressure in the balloon body 10, the valve cover 40 and the insulating piece 50 move synchronously within the shield body 30, until the valve cover 40 blocks up the breather hole 31, the insulating piece 50 disengages itself from the batteries 21, and the batteries 21 are electrically connected with the LED light 22, thereby enabling the LED light 22 to emit light inside the balloon body 10.

When the LED light 22 needs to be turned off and the air needs to be discharged out of the balloon body 10, the valve cover 40 is pressed away from the shield body 30, and the breather hole 31 is opened, which not only enables the air to be discharged out of the balloon body 10, also enables the insulating piece 50 to be inserted between the two batteries 21, thereby turning off the LED light 22. In such a way, the balloon light can be repeatedly used.

The specific embodiments described herein are merely illustrative of the spirit of the present invention. Those skilled in the technical field of the present invention can make various modifications or additions to the specific embodiments described or adopt similar alternates, without departing from the spirit of the present invention or going beyond the scope as defined by the attached claims.

What is claimed is:

1. A pneumatically switched balloon light, comprising:

a balloon body which has an air inlet;

a battery case located in the balloon body, wherein the battery case is provided with two adjacent batteries and an LED light connected with the two batteries;

a shield body located in the air inlet, wherein one end of the shield body is removably connected with the battery case, and the other end is provided with a breather hole;

a valve cover arranged in the shield body and separated from the breather hole;

an insulating piece, one end of which is fixedly connected with the valve cover, and the other end is inserted between the two batteries; and when the air pressure in the balloon body is greater than the atmospheric pressure outside, the valve cover and the insulating piece move synchronously within the shield body, until the valve cover blocks up the breather hole, the insulating piece disengages itself from the batteries, and the batteries are electrically connected with the LED light;

wherein the valve cover has a tapered portion at one end, a tapered socket is correspondingly provided in the shield body, the breather hole is co-axial and communicates with the tapered socket, and the tapered portion is pressed against the surface of the tapered socket.

2. The pneumatically switched balloon light as claimed in claim 1, wherein an insertion-connection block is convexly provided inside the valve cover, and the insertion-connection block is provided with a slot for inserting and fixing the insulating piece.

3. The pneumatically switched balloon light as claimed in claim 1, wherein the outer surface of the battery case is laterally provided with a retaining block, and the inner surface of the shield body is correspondingly made with a retaining groove, such that the retaining block is embedded in the retaining groove.

4. The pneumatically switched balloon light as claimed in claim 3, wherein the outer surface of the battery case is laterally provided with a stop block such that when the retaining block is in the retaining groove, one end of the shield body rests against the stop block.

5. The pneumatically switched balloon light as claimed in claim 1, wherein the outer surface of the battery case is provided with an axially extending breather groove, and the breather groove communicates with the balloon body and the shield body respectively.

6. The pneumatically switched balloon light as claimed in claim 1, wherein a mounting shield is fixedly provided in the battery case, the batteries are located in the mounting shield, a receiving opening is provided in one side of the mounting shield, and an insertion hole corresponding to the receiving opening is made in one end of the battery case, such that the insulating piece is located in the insertion hole and the receiving opening and moves in the insertion hole and the receiving opening.

7. The pneumatically switched balloon light as claimed in claim 1, wherein one end of the battery case is provided with a mounting holder, the inside of which is provided with a mounting groove, the LED light is disposed on a light base, the light base is locked in the mounting groove and the LED light passes through the mounting holder.

8. The pneumatically switched balloon light as claimed in claim 1, wherein a sealing sleeve is provided outside the balloon body, the balloon body is located between the shield body and the sealing sleeve, the sealing sleeve is removably connected with the shield body, and the balloon body is pressed against the sealing sleeve and the shield body respectively.

9. The pneumatically switched balloon light as claimed in claim 8, wherein the shield body is provided with a locking block around the outer surface thereof, and the sealing sleeve is provided with a locking groove around the inner surface thereof, such that the locking block is in the locking groove and the balloon body is pressed against the locking block and the locking groove respectively.

* * * * *